US009534601B2

(12) United States Patent
Ree

(10) Patent No.: US 9,534,601 B2
(45) Date of Patent: Jan. 3, 2017

(54) PUMP

(75) Inventor: Sigurd Ree, Loddefjord (NO)

(73) Assignee: ENHANCED DRILLING AS, Straume (NO)

( * ) Notice: Subject to any disclaimer, the term of this patent is extended or adjusted under 35 U.S.C. 154(b) by 629 days.

(21) Appl. No.: 14/003,546

(22) PCT Filed: Mar. 8, 2012

(86) PCT No.: PCT/NO2012/050037

§ 371 (c)(1),
(2), (4) Date: Sep. 6, 2013

(87) PCT Pub. No.: WO2012/121609

PCT Pub. Date: Sep. 13, 2012

(65) Prior Publication Data

US 2014/0086736 A1 Mar. 27, 2014

(30) Foreign Application Priority Data

Mar. 9, 2011 (NO) ..... 20110356

(51) Int. Cl.

| | |
|---|---|
| ***F04D 1/14*** | (2006.01) |
| ***F04D 29/24*** | (2006.01) |
| ***F04D 29/44*** | (2006.01) |
| ***F04D 29/62*** | (2006.01) |
| ***F04D 5/00*** | (2006.01) |

(Continued)

(52) U.S. Cl.

CPC ..... *F04D 1/14* (2013.01); *F04D 5/001* (2013.01); *F04D 7/04* (2013.01); *F04D 29/242* (2013.01); *F04D 29/445* (2013.01); *F04D 29/605* (2013.01); *F04D 29/628* (2013.01)

(58) Field of Classification Search

CPC ..... F04D 1/00; F04D 1/14; F04D 5/001; F04D 7/02; F04D 13/14; F04D 23/003; F04D 29/42; F04D 29/203; F04D 29/242; F04D 29/426; F04D 29/428; F04D 29/4293; F04D 29/445; F04D 29/605

See application file for complete search history.

(56) References Cited

U.S. PATENT DOCUMENTS

| | | | | |
|---|---|---|---|---|
| 1,754,724 A * | 4/1930 | Mead | F04D 17/10 | 123/559.1 |
| 2,276,827 A * | 3/1942 | Damonte | F04D 3/00 | 415/199.6 |
| 3,244,109 A | 4/1966 | Barske | | |

(Continued)

FOREIGN PATENT DOCUMENTS

| | | |
|---|---|---|
| CN | 2301566 Y | 12/1998 |
| GB | 333443 A | 8/1930 |

*Primary Examiner* — Eric Keasel
*Assistant Examiner* — Jason Davis
(74) *Attorney, Agent, or Firm* — Foley & Lardner LLP

(57) ABSTRACT

A pump varies output flow. For all cross-sections, which are vertical to the axis of rotation between axial outer positions for the cross-sectional areas of flow at the periphery of the impeller, the inner wall of the pump housing forms approximately circular profiles. The approximately circular profiles are mainly concentric and have a continuously increasing radius from one toward the other one of the axial outer positions. A tongue, which truncates the outlet or diffuser of the pump from an annulus of the pump housing, does not contact the circular profiles between the axial outer positions.

13 Claims, 5 Drawing Sheets

SECTION A-A

(51) Int. Cl.
*F04D 7/04* (2006.01)
*F04D 29/60* (2006.01)

(56) References Cited

U.S. PATENT DOCUMENTS 3,387,769 A * 6/1968 Hunt ..... F04D 13/14
415/62
4,872,809 A * 10/1989 Addie ..... F04D 7/04
415/206
4,940,385 A 7/1990 Gurth

* cited by examiner

SECTION A-A

SECTION B-B

SECTION C-C
SCALE 1 : 5

DETAIL D
SCALE 2 : 5

PUMP

BACKGROUND AND SUMMARY

This invention concerns a rotodynamic pump for varying output flow, for example suitable for recirculation of drilling fluid and transport of drill cutting from an underwater drilling operation to a separator on a surface drilling rig or similar. Among other things, the following is characteristic of such pumping operations:

- The output flow varies quickly and frequently, also including regular full stops for making-up a drill string.
- Frequently a disproportionately large lifting height relative to the output flow, as viewed from an ideal position for rotodynamic pumps.
- Transport of drill cuttings with a varying size and hardness, and at the risk of random inclusions of rocks sized up to ~Ø 50-75 mm.
- Return of the drilling fluid is equally important to the return of cuttings, the mixing ratio of solids-liquid is typically 1-5% as defined by the application, and cannot be adapted to the pump.
- The lifting height must be maintained approximately at full height during full stop in the output flow. Possible backflow of cuttings over time when at full stop in the output flow must not cause clogging or in any other way complicate a fast re-establishment of a full output flow.
- The temperature must not quickly become critically high at a low output flow and a large lifting height.
- The drill cutting must not become finely distributed by the pump so as to render it difficult to separate.
- The pump must be able to operate continuously without interruptions for maintenance over periods of a few days to several months.
- The drilling fluid will exhibit large variations in density and viscosity.
- The weight of the system, which includes the motor, regulator, power supply, hoses, pipes and cables, is critical.
- Non-scheduled maintenance is to be carried out effectively offshore.

Thus far, disc pumps have essentially been used for the purpose, for example as described in U.S. Pat. No. 4,940,385. In principle, this concerns centrifugal pumps wherein the impeller consists of discs without blades, but with certain ribs or recesses contributing to accelerate the liquid in the best possible manner by means of shear forces. Among other things, the absence of blades offers the advantage of solid particles obtaining a considerably lower tangential velocity than the liquid, whereby erosion is reduced in both the disc and the pump housing. However, the efficiency and lifting height is reduced considerably relative to typical centrifugal pumps with blades. This is of particular relevance when pumping a liquid having low viscosity. Pumps of this type are suitable for high-viscosity liquids.

It may appear obvious to look onto the mining industry to find a pump design suitable for the above-mentioned application. Here, however, the lifting height requirement is normally lower, and the output flow requirement is even higher. The medium of pumping is usually water at volumes freely adaptable to the requirement of the pump. Common solutions involve large and heavy centrifugal pumps with moderate rotational speeds, but nevertheless with a higher specific velocity than what is possible to accommodate specific lifting height requirements. Typically, these pumps have heavy-duty, hard-wearing blades with a low pitch angle. With respect to the largest solid particle which is allowed to pass, the size of the pumps oftentimes makes the consideration less restricting concerning the optimization of the number and width of blades. The concentration of solid particles is high in these pumps, and a slurry having 20-30% of solid particles is typical. The high concentration of solid particles causes a lesser extent of heavier particles being hurled out at a high radial velocity toward the walls of the pump housing, which is due to the individual particle's freedom of movement, relative to the main flow, becoming more restricted. These "material pumps" are indeed heavily exposed to erosion and abrasion, but they may possibly be less exposed to situations where singular, heavy, hard and sharp particles hit the walls of the pump housing hard enough to cause e.g. a surface coating, such as tungsten carbide or similar, to become crushed or disintegrate into flakes.

It is commonly recognized that in order to achieve a high efficiency in a centrifugal pump, among other things, it is of advantage to shape the pump housing as a volute casing having, across the circumference, a gradually increasing cross-sectional area of flow toward the outlet, whereby the flow of liquid discharging from the periphery of the impeller may be distributed evenly across the circumference, and at a tangential velocity adapted to the rotational speed of the impeller and the profile of the blades. Usually—but not always—the entire length of the central axis in the cross-sectional area of flow of the volute casing lies in the same plane as a circle envisaged along the periphery of the impeller, and in the middle of the cross-sectional area of flow thereof.

When a volute casing is to be designed, however, the starting point must be a given output flow, a given impeller design, and a given rotational speed. A particular lifting height for the pump is also associated with these conditions. These design criteria correspond to what is termed as the pump's BEP—"best efficiency point".

For a pump having constantly varying operating conditions—for example at regular periods at a sustained lifting height and no output flow—any choice of a volute casing design will be less than optimum during larger or smaller parts of the operating time. The flow of liquid leaving the impeller and flowing through the volute casing toward the outlet will, in cases of very low flow output, suddenly experience a virtual "wall" having a relatively large cross-section at the outlet. This results in strong turbulences, efficiency losses, erosion on the tongue at the outlet from the pump housing, local backflow into the impeller with subsequent erosion on the blades, and high pressure differences and vibrations across the circumference, which in turn inflicts large loads on the radial bearings of the impeller. There will also be a danger of critical heating in the pump.

In a disc pump in accordance with the above-mentioned U.S. Pat. No. 4,940,385, the disadvantages of operation outside BEP are reduced by virtue of the pump housing being of a cylindrical shape and having the same axis as the impeller, however arranged in a manner allowing the liquid to discharge from the pump housing through a rectilinear outlet at the periphery of the pump, and in a plane perpendicular to the axis of rotation and centred in the pump housing. Under no operating conditions will a pump having such a design achieve as high efficiency as what a corresponding centrifugal pump having a volute casing will achieve at around BEP, but the efficiency as well as the radial forces stabilize, in many cases, at an acceptable level within a window of operation. A cylindrical pump housing like this, however, will inflict new disadvantages if combined with a typical impeller having blades that divide the internal volume of liquid in the impeller into clearly separated masses, and where substantial throughput only is possible between the two blades passing at any time closest to the tongue at the pump outlet. By virtue of such a design, the throughput in the impeller will have to occur in bursts and constantly move between different blades.

The object is achieved by virtue of features disclosed herein.

Accordingly, the present invention may set forth to combine the best virtues of a disc pump having a cylindrical pump housing on one side, and a centrifugal pump having impeller blades and a volute casing on the other side, and combine considerations with respect to the partly contradictory requirements mentioned above in a better way than what has, thus far, been possible with known technology.

The object is achieved by virtue of features disclosed in the following description and in the subsequent claims.

A rotodynamic pump for varying output flow is provided, which is characterized in that in all cross-sections, which are vertical to the axis of rotation between axial outer positions for cross-sectional areas of flow at the periphery of the impeller, the inner wall of the pump housing forms approximately circular profiles being mainly concentric and having a continuously increasing radius from one toward the other one of said axial outer positions, and wherein a tongue, which truncates the outlet or diffuser of the pump from the annulus of the pump housing, does not contact said circular profiles between said axial outer positions.

The rotodynamic pump may comprise that the medium is conducted out of the cavity of the pump housing through a pump outlet with a cavity that cuts through the inner wall of the pump housing at the periphery on the side of the axial extent of the impeller where the radius of the inner wall of the pump housing is the largest.

The rotodynamic pump may comprise that the pump outlet cuts through the inner wall of the pump housing in an annulus, which is partly shielded from those parts of the cavity of the pump housing located closest to the impeller, and through a circular wall which, between the annulus and the impeller, extends radially outwards along the periphery of the impeller and along the inner radius of the annulus, however without cutting off the liquid communication between the impeller and the annulus.

The rotodynamic pump may comprise that the pump housing has a demountable front plate with a radius being marginally larger than the impeller, wherein the front plate is arranged in both axial and radial directions within the annulus, wherein seals are arranged between the front plate and other parts of the pump housing, and wherein the front plate is locked in an axial position by means of radial displacement of locking dogs extending outwards and into adapted recesses in the inner external wall of the annulus.

The rotodynamic pump may comprise that interchangeable front plates are individually integrated with various pipe bends forming the suction nozzle of the pump, and wherein the front plate with a pipe bend is capable, during mounting, of being rotated about the axis of rotation of the pump, and in any direction relative to the outlet, at least before it is locked down with the locking devices.

The rotodynamic pump may comprise that at least one selectable front plate has a pipe bend terminated with a flange adapted to corresponding flanges on the outlets of corresponding pumps, whereby two or more corresponding pumps are capable of being connected directly together, in series, in one or more compact ways without use of further transition pipes, bends or hoses.

The rotodynamic pump may comprise that the medium is conducted out of the pump housing through a channel shaped as a volute casing and positioned, in its entirety, outside the axial border positions for the cross-sectional area of flow at the periphery of the impeller, and wherein the centre line in said channel forms a helical line having an increasing distance from the axis of rotation, as viewed in a co-current direction, and an increasing axial distance from a motor toward the suction side of the pump.

The rotodynamic pump may comprise that it is equipped with an impeller of the disc-type, wherein two or more discs are held together only by small spacers, and wherein the internal side surfaces of the discs may be equipped with grooves in order to increase entrainment of liquid, however such that solid particles mainly are accelerated tangentially only due to flow resistance in the liquid and hence obtain a lower tangential velocity than the liquid.

The rotodynamic pump may comprise that it is equipped with an impeller having blades arranged in pairs, wherein the first blade in each pair starts at the smallest radius practically possible for free passage of the largest solid particle to be pumped, wherein said first blade has a low pitch angle, and wherein the second blade in each pair starts at a considerably larger radius than the first blade and is positioned, as viewed in the direction of rotation, in front of the first blade at such a distance that the largest and heavier particle to be pumped is allowed to pass underneath, and wherein the pitch angle of the second blade in each pair is considerably larger than that of the first blade in each pair.

BRIEF DESCRIPTION OF THE DRAWINGS

Hereinafter, an example of a preferred embodiment is described and is depicted in the accompanying drawings, where S generally denotes the suction side of the pump and M denotes the motor or the motor side of the pump, and where.

DETAILED DESCRIPTION

Figure 1:
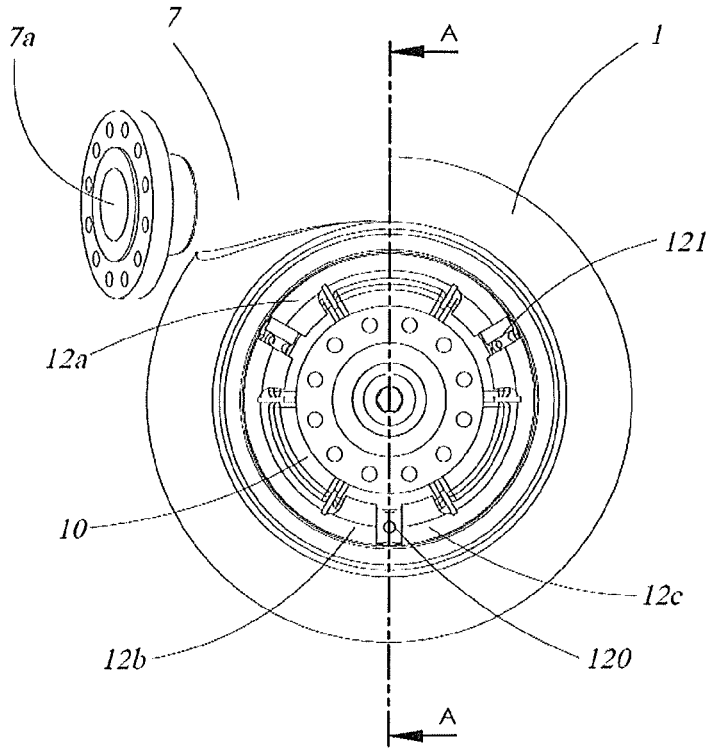
FIG. 1 shows an exemplary embodiment of an assembled pump 1 as viewed from the suction side.
Figure 2:
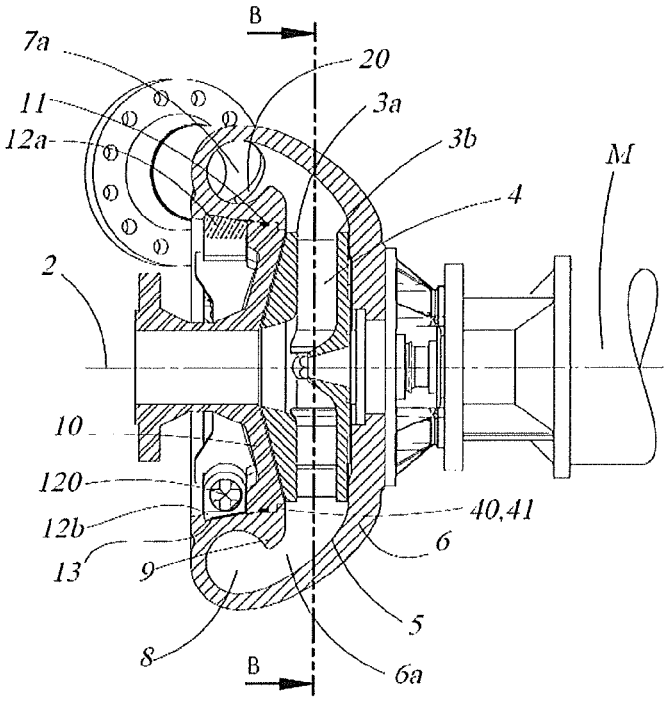
FIG. 2 shows cross-section A-A of the exemplary embodiment in FIG. 1, and with particular emphasis on illustrating the cavity profile of the pump housing.
Figure 3:
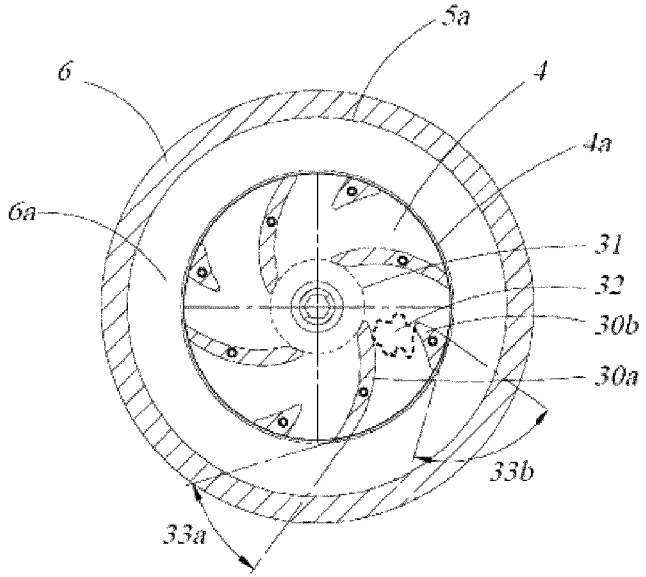
FIG. 3 shows cross-section B-B of the exemplary embodiment in FIG. 2 and clarifies the circular profile of the pump housing.

In the exemplary embodiment shown in FIG. 1, FIG. 2 and FIG. 3, the medium of pumping is conducted centrally into an eye of an impeller 4 via a flanged, straight suction nozzle integrated with a front plate 10. The impeller 4 rotates about the axis 2 and is driven by a motor M. A Section B-B through the impeller 4 and a pump housing 6 is shown in FIG. 2. The inner wall 5*a* of the pump housing 6, see FIG. 3, as viewed along this section, forms a circle which is concentric with the impeller 4, and which is not broken by any parts of a tongue 20, which separates the pump housing 6 from an outlet channel 7. FIG. 2 shows that the same will be the case independent of axial position of section B-B between the outer positions 3*a*, 3*b* for cross-sectional areas of flow at the periphery 4*a* of the impeller 4, see FIG. 3.

Further, from FIG. 2 it is apparent that in this exemplary embodiment, the radius of the inner wall 5 of the pump housing increases with increasing distance from the motor M. In the axial section A-A in FIG. 2, the inner wall 5 of the pump housing 6 follows an approximately elliptical curve, where the longest radius in the ellipse is inclined about 40° relative to the axis of rotation 2. The increasing downstream radius as well as an increased flow distance to the tongue 20 has several consequences: The volume of liquid in the pump housing 6 outside the impeller 4 becomes larger and typically corresponds to considerably more than the volume flowing through the impeller 4 during one revolution. This provides a longer detention period for the liquid in the pump housing, which indeed results in a larger hydraulic loss in the pump when operating near BEP, but which also increases, at all output flows, the lifting height of the pump by virtue of the rotating liquid outside the impeller 4 inflicting further centrifugal forces onto the liquid. The rotation speed of the liquid will decrease gradually with increasing distance from the impeller 4, and will, before reaching the tongue 20, have become significantly closer to that corresponding to an average speed in an outlet opening 7*a* when at a particular output flow. Reduced output flows will therefore interfere to a much lesser extent with the flow of liquid in the pump housing 6, and will increase the erosion and hydraulic losses to a smaller extent, than for typical volute casings. Retardation of the liquid takes place relatively evenly and regularly along the relatively smooth and uninterrupted wall surfaces of the pump housing.

Another effect of the axial angle of inclination (in this case ~40° relative to the axis of rotation 2) of the inner wall 5 of the pump housing 6 will be that heavier, solid particles being hurled out of the impeller 4 at a considerably higher radial velocity than the liquid, will hit the inner wall 5 of the pump housing 6 at a considerably smaller angle of attack than what would be the case if the pump housing 6 was cylindrical or shaped as a volute casing where the centre line in the outlet was lying in the same plane as the central plane in the cavity at the periphery 4*a* of the impeller. For many metals and surface coatings, the influence of impacts from solid particles will be largest when at an angle of attack of about 45° onto the surface. When the ratio between radial- and tangential velocity out of the impeller is taken into consideration, cf. e.g. blade pitch 33*a* in FIG. 3, a 40° axial inclination will guarantee that the final resultant angle relative to the wall surface becomes considerably less than 45° in any case.

A third effect of the conicity of the wall toward the outlet opening 7*a* is that heavier particles will move faster than the liquid toward those positions where the tangential velocity is lowest, the outlet is closest and the detention period is shortest. This will also contribute to reduced erosion at all output flows, and particularly at a considerably lower output flow than that corresponding to BEP.

A further advantage of the invention according to this and other exemplary embodiments will be that the radial forces onto the impeller will decrease considerably, particularly when the pump is in an operation situation far outside BEP, because the pressure in the cavity 6*a* in the pump housing outside the impeller 4 is distributed considerably more even across the circumference.

Figure 6:
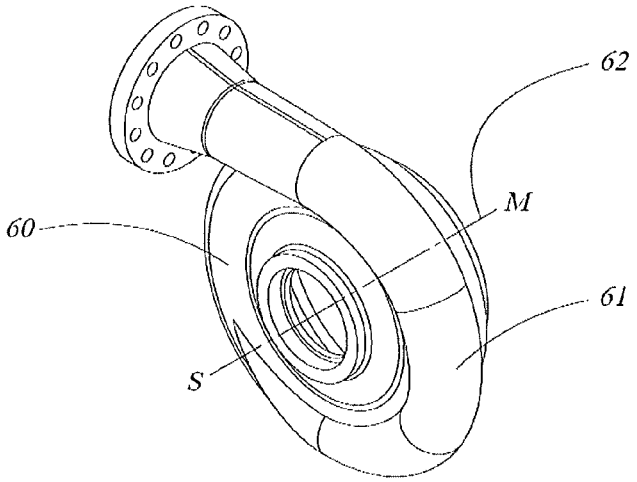
FIG. 6 shows, in perspective, an alternative design of a pump housing in accordance with the invention.

It appears, especially for this exemplary embodiment, and particularly from FIG. 2, that the pump also has been provided with a circular annulus 8 partly separated, by virtue of a wall 9, from the annulus located immediately outside the impeller 4. The fact that the pump housing 6, outside the axial border positions 3*a*, 3*b*, also has circular inner walls—however partly separated herein by the tongue 20—further enhances the suitability of the pump for very varying output flows. This embodiment, however, is not limiting for the scope of protection, and it does not exist in, for example, the alternative exemplary embodiment shown in FIG. 6, where a pump housing 60 is configured such that a medium is conducted out of the pump housing 60 through a channel 61 shaped as a volute casing and positioned, in its entirety, outside the axial border positions 3*a*, 3*b* for the cross-sectional area of flow at the periphery of the impeller, and where the center line in the channel 61 forms a helical line having an increasing distance from the axis of rotation 62.

In all of the FIGS. 1-5, the same design of the very pump housing 6 is shown. The relatively large cavity volume, including cavity 6*a*, and circular annulus 8, and the axial width of this pump housing 6 implies that it is easy to construe that it becomes heavier than more typically shaped pump housings for centrifugal pumps. The axial extent of the pump housing 6, however, also provides for a weight-reducing design of a front plate 10, 10*a* which, when finally mounted, is located within the axial extent of the pump housing 6 and has a radius being marginally larger than the impeller 4. In this embodiment, the traditional bolt connections between the pump housing and the front plate are replaced with a small number of radially extending locking dogs 12*a*, 12*b*, 12*c* engaged within an adapted recess 13 in the inner external wall 13*a* of the annulus 8. A conical contact surface between the locking dogs 12*a*, 12*b*, 12*c* and the corresponding recess 13 in the pump housing 6 results in axial fixation of the front plate 10 and, at the same time, to a larger or smaller degree of metallic, radial sealing between contact surfaces 40 and 41. The metallic sealing stops the majority of solid particles and keeps the erosion away from the axial, primary fluid seal 11, which for example has the form of an O-ring with or without support rings.

Figure 4:
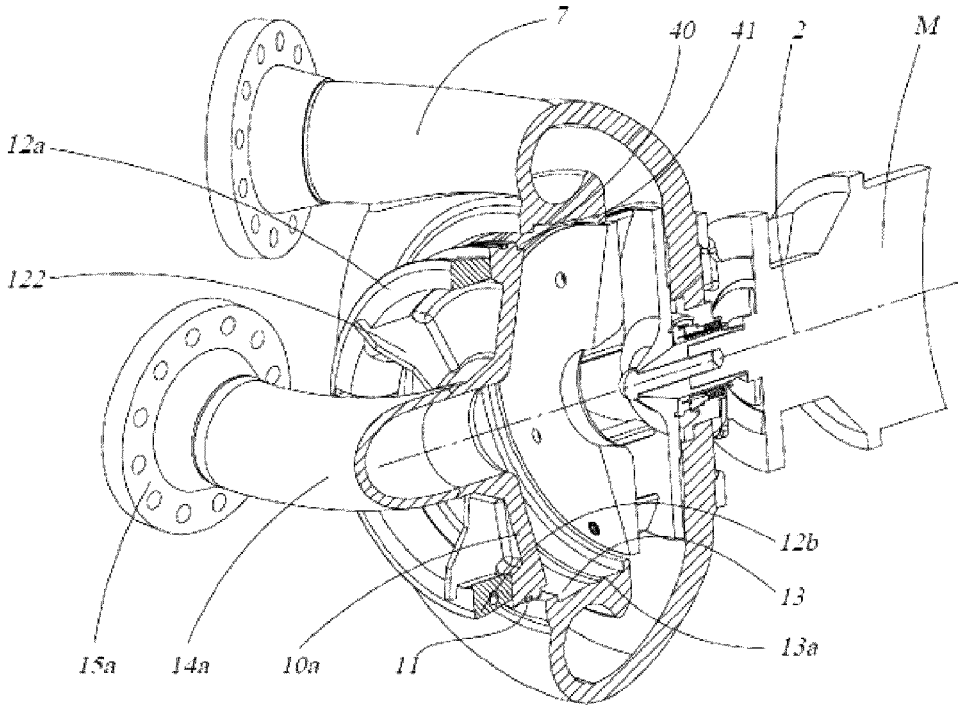
FIG. 4 shows, in perspective, a cross-section positioned equal to that of FIG. 2 relative to the pump housing, however shown herein with a different front plate design having a suction inlet, which also is partly demounted in order to illustrate a locking mechanism.

In FIG. 4, an exemplary embodiment of the front plate 10*a* is shown comprising an integrated 90° bend 14*a* and a flange 15*a* on the suction side of the pump. Further integrated with the front plate there are a number of struts 122 which, besides allowing for a smaller material thickness of the very front plate 10*a*, also supports and positions the locking dogs 12*a*, 12*b*, 12*c* when compressed and prepared for mounting of the front plate, as shown in FIG. 4. Attention is drawn to the fact that the conical outer surfaces will contribute to centre and guide the front plate onward to the correct locking position, as shown in principle in FIG. 2—however with another shape of the suction nozzle.

Figure 5:
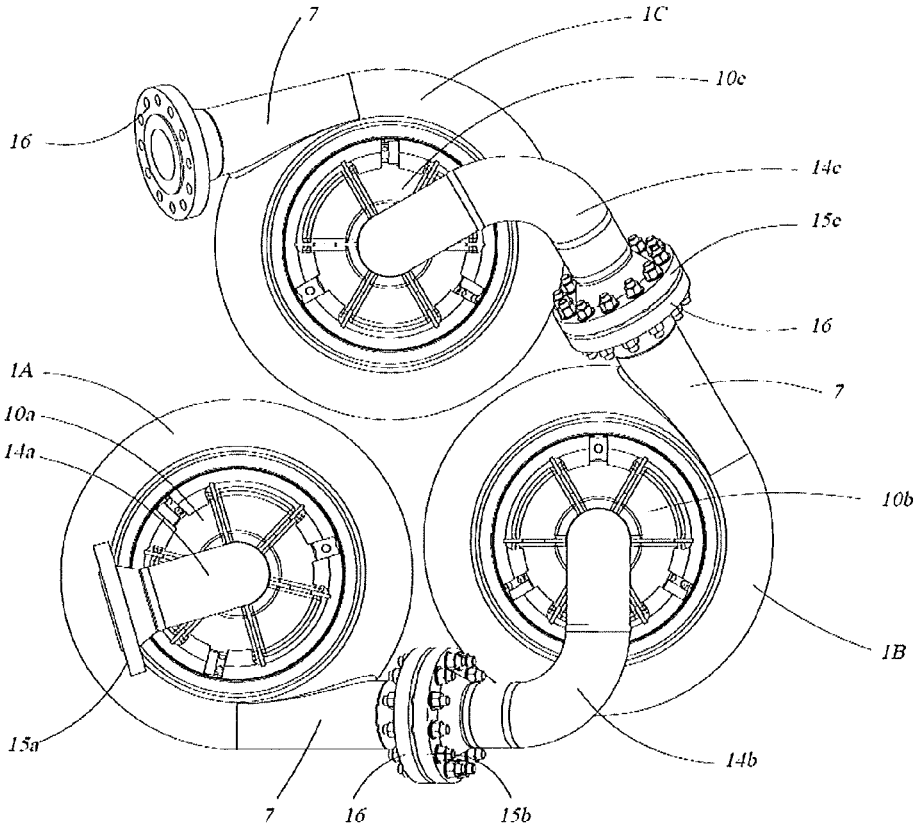
FIG. 5 shows, as viewed from the suction side, an assembly of three pumps in accordance with the invention and mounted in series for increased lifting height.

The locking mechanism described above and shown in further detail in FIGS. 8A, 8B, 8C and 8D, allows for a stepless adaptation of the direction of rotation of the pipe bends 14*a*, 14*b* forming the suction nozzle about the axis of rotation 2, of S-M relative to the pump outlet 7, and adapted to a random assembly. Several pumps 1A, 1B, 1C may easily be connected in series in a compact way, for example as shown in FIG. 5, where three pumps are arranged in the same plane and vertical to the axis of rotation, and with the flange 16 of the suction nozzle and outlet flange 15*b*, 15*c* connected directly together without any intermediate pipe bends. In this manner, a possible weight-increase of each individual pump housing may be compensated for, fully or partly, by a favourable total weight of an assembled pump module having several pumps arranged in series for larger lifting height. In an oil service industry which is to serve drilling operations at a wide range of ocean depths the flexibility of interconnecting a selectable number of pumps for various tasks will be preferable to singular multistage pumps having a number of impellers built into the same pump housing and driven by the same motor.

Figure 8A:
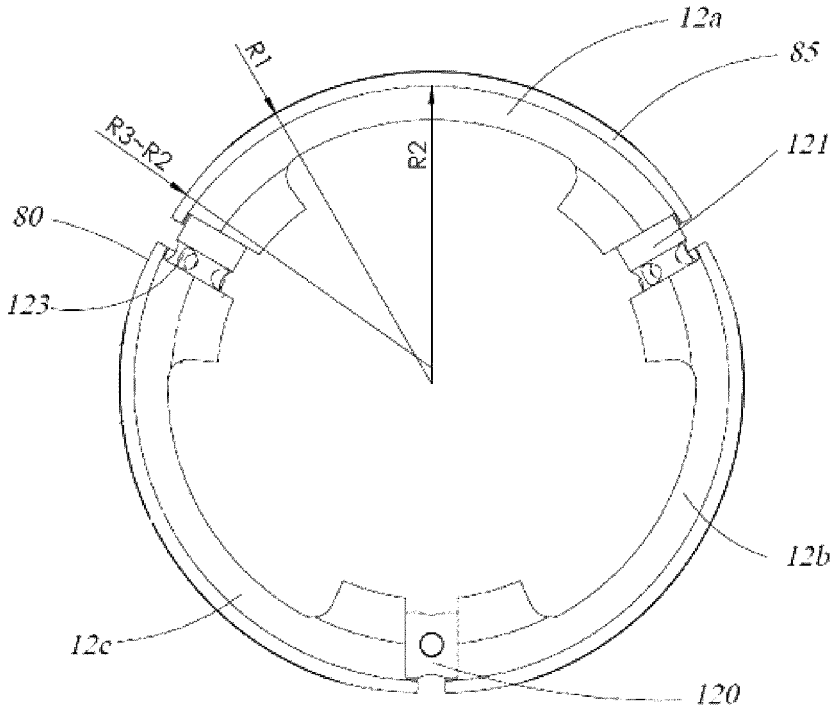
FIG. 8A-8D illustrate details in the locking mechanism for the front plate of the pump, which in FIG. 2 is shown when closed, and in FIG. 4 is shown when open.
Figure 8B:
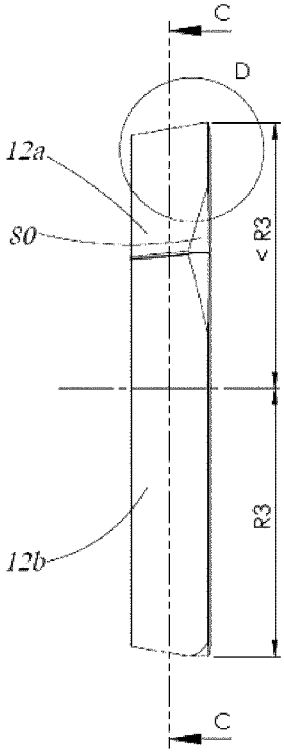
Figure 8C:
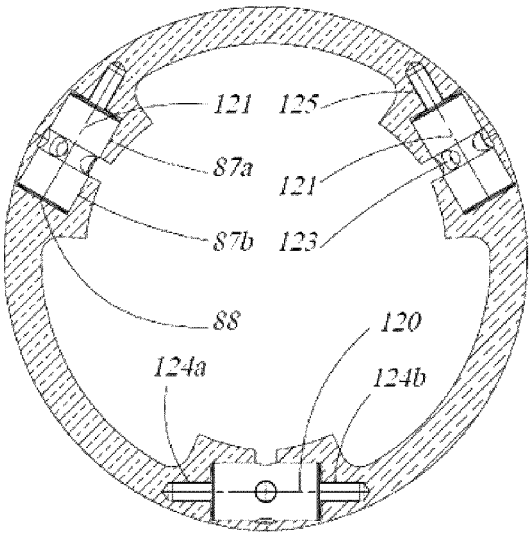
Figure 8D:
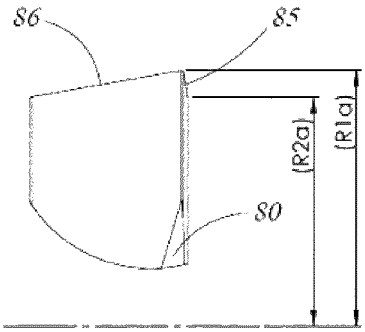

FIGS. 8A-8D show an example of how several locking dogs 12*a*, 12*b*, 12*c*, together with combined bolts 120, 121, may form a locking ring where only one bolt 120 keeps the parts of the locking ring together and is equipped with threads at both sides, for example a right-handed thread 124*a* and a left-handed thread 124*b*, whereas two other bolts 121 are equipped with threads only at one side 125 and a spherical gliding contact surface 88 at the opposite side. Guide surfaces 87*a*, 87*b* keep the parts 12*a*, 12*b*, 12*c* precisely in line in the axial direction and have a diameter suitable for withstanding a significant torque. In FIGS. 8B and 8C, the locking mechanism is shown in an open position and prepared for mounting or demounting of the front plate. The locking dogs 12*a*, 12*b*, 12*c* are then joined with direct metallic and mutual contact. In this position, the locking ring assembly is non-circular, like a triangle with curved side surfaces. In FIG. 8A, the locking dogs are displaced away from each other into a locked position, and the assembly is then mainly circular with the outer radius R1 of each singular locking dog being identical to the outer radius of the assembly. Only in this locked position, the conical contact surfaces 85 of the locking dogs will have contact, across the entire length thereof, with the corresponding surface of the recess 13 of the pump housing. In order to limit the required distance between the locked and open position, the corners in the "triangle", which is formed in the open position, may be rotated somewhat downwards until the surfaces 80 have a radius R3 corresponding to an inner radius R2 for the conical contact surface, however with a centre of rotation displaced outwards relative thereto. In the open position—i.e. when compressed—the assembly of the locking dogs will then have an outer radius limited to R2, which is required to allow for mounting and demounting in the pump housing. The assembling is carried out by displacing, at first, the front plate and the locking ring axially, and centred by the conical guide surface 86, FIG. 8D, until contact is reached between the surfaces 40 and 41. Then the locking rings are screwed toward the locked position by rotating the bolt 120 by means of a suitable tool with a pin or rod fitting into the holes on the screw head. When the lock is somewhat tightened by means of the bolt 120 only, it is tightened further by means of the other bolts 121 having holes 123 into which the tool also fits. A conical contact surface 85 functions like a wedge and the surfaces 40 and 41 will provide a better protection against erosion near an axial fluid seal 11 if the locking wedge is tightened properly and the friction against the contact surfaces 85 is not too high. Nevertheless, this is not critical to ensure tight and safe mounting capable of withstanding the pressure in the pump housing. Advantageously, the conicity of the surface 85 is such that the friction becomes approximately equal to the radial component of the axial forces exerted on the surface. The bolts 120, 121 will then experience moderate loads on the threads and may be secured in a simple manner with, for example, a wire through the holes 123 for the tool.

Figure 7:
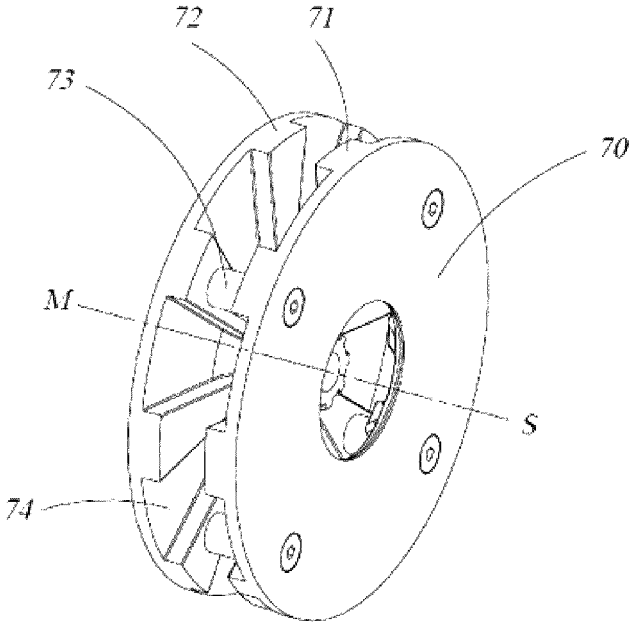
FIG. 7 shows an alternative design of an impeller capable of being mounted in a pump in accordance with the invention.

The invention puts no limitation with respect to the shape of the impeller. Two possible exemplary embodiments, which in different ways enhance some of the advantages of the invention, are depicted with figures. These shall be described below:

FIG. 7 concerns an impeller 70 of the disc-type, which is known per se, corresponding to what has been discussed previously in context of the prior art, i.e. U.S. Pat. No. 4,940,385, where two or more discs 71, 72 are held together only by small spacers 73, and where internal side surfaces of the two or more discs 71, 72 are equipped with grooves 74 configured to increase entrainment of fluid such that solid particles are mainly accelerated tangentially only due to flow resistance in the fluid so as to obtain a lower tangential velocity than the fluid. Today, this type of impeller is used for pumping of drilling fluid and drill cuttings, despite exhibiting a moderate efficiency and pump head, because it is favourable with respect to erosion in the impeller and the pump housing. Used in combination with a pump housing as described herein, the erosion will be reduced further and the minimum pump head is maintained relative to the current disc pumps.

FIG. 3 illustrates an impeller having a new shape adapted particularly to pumping of drilling fluid and cuttings. The shape of this impeller is presented simultaneously with this application, insofar as this will also provide advantages in context of several other types of pump housings. When combined with the pump housing of the present patent application, this provides a better pump head and efficiency than that of the disc-type impeller. Expected erosion becomes somewhat bigger than with disc-type impellers, but not bigger than hitherto known disc pumps, which will have a lower efficiency and pump head. This new impeller, see FIG. 3, is comprised of blades 30*a*, 30*b* arranged in pairs, wherein the first blade 30*a* in each pair starts at the smallest radius 31 practically possible for free passage of the largest solid particle 32 to be pumped. The first blade 30*a* catches heavy particles which, before they hit the blade, slow down tangentially relative to the liquid. The low pitch angle 33*a* of the blades, together with the tendency of the heavier particles to become hurled out radially faster than that of the liquid, only cause the particles to accelerate insignificantly more in the tangential direction than they would do in a corresponding impeller of the disc-type. The blades with the low pitch angle 33*a* form a favourable compromise between the desire for little erosion and large pump head, insofar as the significance of the pitch angle on the tangential velocity is proportional to the radial velocity. The particles already hurled toward the periphery at a moderate tangential velocity, will, to a smaller extent than the liquid, be accelerated in the tangential direction by the blades, which are formed in a manner whereby they, as close as possible, follow the path that critically heavy particles would follow in an impeller of the disc-type. The second blade 30*b* in each pair starts at a considerably larger radius than the first blade 30*a* and is positioned, as viewed in the direction of rotation, in front of the first blade 30*a* at such a distance that the largest and heavier particle 32 to be pumped is allowed to pass underneath. Given that the heavier particles may be assumed to mainly slow down tangentially, whereby they either follow the front of the first blade 30*a* or at least pass underneath the second blade 30*b*, the pitch angle 33*b* of the second blade will influence the velocity of the heavier particles insignificantly. In order to improve the pump head, the pitch angle 33*b* may therefore be made significantly steeper than for the first blade and, moreover, it may contribute to limit the distance between the blades near the periphery, thereby reducing hydraulic losses in the form of slowing down and backflow of liquid between the blades.

In view of the preceding description and accompanying drawings, the subsequent claims are assumed to clearly define the scope of what is sought protected via a patent.

The invention claimed is:

1. A pump, comprising:

an impeller having a periphery;

a pump housing having an inner wall with an annulus; and a tongue that truncates an outlet or a diffuser from the annulus of the pump housing, wherein the inner wall of the pump housing forms approximately circular profiles in all cross-sections between two axial outer positions for cross-sectional areas of flow at the periphery of the impeller, the cross-sections being between the two axial outer positions and vertical to an axis of rotation, wherein the approximately circular profiles are mainly concentric with the impeller and have a continuously increasing radius from one of the two axial outer positions toward the other one of the two axial outer positions, and wherein the tongue does not contact the approximately circular profiles between the two axial outer positions.

2. The pump according to claim 1, wherein the pump housing forms a pump cavity configured such that a medium is conducted out of the pump cavity through a pump outlet via an outlet cavity that cuts through the inner wall of the pump housing at a periphery of the inner wall on a side of an axial extent of the impeller where a radius of the inner wall is largest.

3. The pump according to claim 1, wherein a pump outlet cuts through the inner wall of the pump housing via the annulus, and wherein the annulus is partly shielded from a section of the pump cavity located closest to the impeller.

4. The pump according to claim 3, wherein the pump outlet cuts through a circular wall, and wherein the circular wall is located between the annulus and the impeller, and extends radially outwards along the periphery of the impeller and along an inner radius of the annulus without cutting off fluid communication between the impeller and the annulus.

5. The pump according to claim 1, wherein the pump housing comprises a demountable front plate with a radius being larger than a radius of the impeller, and wherein the front plate is arranged in both axial and radial directions within the annulus.

6. The pump according to claim 5, wherein at least one seal is arranged between the front plate and a portion of the pump housing, and wherein the front plate is locked in an axial position by locking devices extending outwards and into adapted recesses in an inner external wall of the annulus.

7. The pump according to claim 5, wherein the front plate is individually integrated with a pipe bend forming a suction nozzle, and wherein the front plate is configured, during mounting, to be rotatable about an axis of rotation in any direction relative to the outlet at least before the front plate is locked down with a locking device.

8. The pump according to claim 7, wherein the pipe bend is terminated with a flange that is adapted to mate with a corresponding flange on an outlet of another pump such that the pump and the another pump are capable of being connected directly together in series in one or more compact ways without use of further transition pipes, bends or hoses.

9. A pump system comprising:

a plurality of pumps, each of the plurality of pumps being a pump according to claim 5, wherein the front plates of the plurality of pumps are individually integrated with one of a plurality of pipe bends forming suction nozzles of the plurality of pumps, and wherein the front plates are configured, during mounting, to be rotatable about an axis of rotation in any direction relative to the outlet at least before the front plates are locked down with locking devices.

10. The pump system according to claim 9, wherein at least one of the front plates has a pipe bend terminated with a flange configured to mate with a corresponding flange on an outlet of a corresponding pump such that two or more corresponding pumps are capable of being connected directly together, in series, in one or more compact ways without use of further transition pipes, bends or hoses.

11. The pump according to claim 1, wherein the pump housing is configured such that a medium is conducted out of the pump housing through a channel shaped as a volute casing, wherein the channel is positioned, in its entirety, outside the two axial outer positions for the cross-sectional areas of flow at the periphery of the impeller, and wherein a center line in the channel forms a helical line having an increasing distance from the axis of rotation, as viewed in a co-current direction, and an increasing axial distance from a motor toward a suction side of the pump.

12. The pump according to claim 1, wherein the impeller comprises two or more discs held together only by small spacers, and wherein internal side surfaces of the two or more discs are equipped with grooves configured to increase entrainment of fluid such that solid particles are mainly accelerated tangentially only due to flow resistance in the fluid so as to obtain a lower tangential velocity than the fluid.

13. The pump according to claim 1, wherein the impeller comprises blades arranged in pairs, wherein a first blade in each pair starts at a smallest radius for free passage of a solid particle to be pumped, wherein the first blade in each pair has a first pitch angle, wherein a second blade in each pair starts at a larger radius than the first blade in each pair and is positioned, as viewed in a direction of rotation, in front of the first blade in each pair at such a distance that the solid particle to be pumped is allowed to pass underneath, and wherein a second pitch angle of the second blade in each pair is larger than the first pitch angle of the first blade in each pair.

* * * * *